US008733859B2

(12) United States Patent
Shewmaker et al.

(10) Patent No.: US 8,733,859 B2
(45) Date of Patent: May 27, 2014

(54) SILVERWARE BASKET FOR A DISHWASHER APPLIANCE

(75) Inventors: Darrell W. Shewmaker, Georgetown, IN (US); Ryan James Diener, Louisville, KY (US); William Nathan Garnett, Ekron, KY (US); Daniel J. Hart, Louisville, KY (US)

(73) Assignee: General Electric Company, Schenectady, NY (US)

( * ) Notice: Subject to any disclaimer, the term of this patent is extended or adjusted under 35 U.S.C. 154(b) by 24 days.

(21) Appl. No.: 13/493,272

(22) Filed: Jun. 11, 2012

(65) Prior Publication Data

US 2013/0328465 A1 Dec. 12, 2013

(51) Int. Cl.
*A47B 77/08* (2006.01)

(52) U.S. Cl.
USPC ..... 312/228.1; 211/41.9

(58) Field of Classification Search
USPC ..... 312/228, 228.1; 211/41.9, 41.8, 41.5, 211/41.6, 126.1, 132.1, 133.6, 120.16; 220/831, 832, 840
See application file for complete search history.

(56) References Cited

U.S. PATENT DOCUMENTS

| | | | | | |
|---|---|---|---|---|---|
| D254,187 | S | * | 2/1980 | Freese | D32/3 |
| 5,287,984 | A | * | 2/1994 | Michael | 220/812 |
| D487,825 | S | * | 3/2004 | Kim et al. | D32/3 |
| D488,891 | S | * | 4/2004 | Smith et al. | D32/3 |
| 7,694,844 | B2 | * | 4/2010 | Woo | 220/756 |
| 8,151,810 | B2 | * | 4/2012 | House et al. | 134/135 |
| 2002/0139809 | A1 | * | 10/2002 | Barry et al. | 220/762 |
| 2006/0065666 | A1 | * | 3/2006 | Dunn et al. | 220/676 |
| 2007/0039636 | A1 | | 2/2007 | Egger et al. | |
| 2008/0272126 | A1 | * | 11/2008 | Crookshanks et al. | 220/486 |
| 2008/0302397 | A1 | | 12/2008 | Buhlmeyer et al. | |
| 2010/0194254 | A1 | * | 8/2010 | House et al. | 312/228.1 |
| 2011/0309098 | A1 | * | 12/2011 | Hayashi et al. | 220/829 |

FOREIGN PATENT DOCUMENTS

WO WO 2006/010711 A2 2/2006

* cited by examiner

*Primary Examiner* — Daniel Rohrhoff
(74) *Attorney, Agent, or Firm* — Dority & Manning, P.A.

(57) ABSTRACT

A silverware basket for a dishwasher appliance is provided. The silverware basket appliance includes features for selectively securing a cover of the silverware basket in an open position. To selectively secure the cover in an open position, the silverware basket can include a pin with a noncircular cross-section that rotatably mounts the cover to the silverware basket or a recess defined by a brace that can receive a portion of the cover in the open position or both.

19 Claims, 9 Drawing Sheets

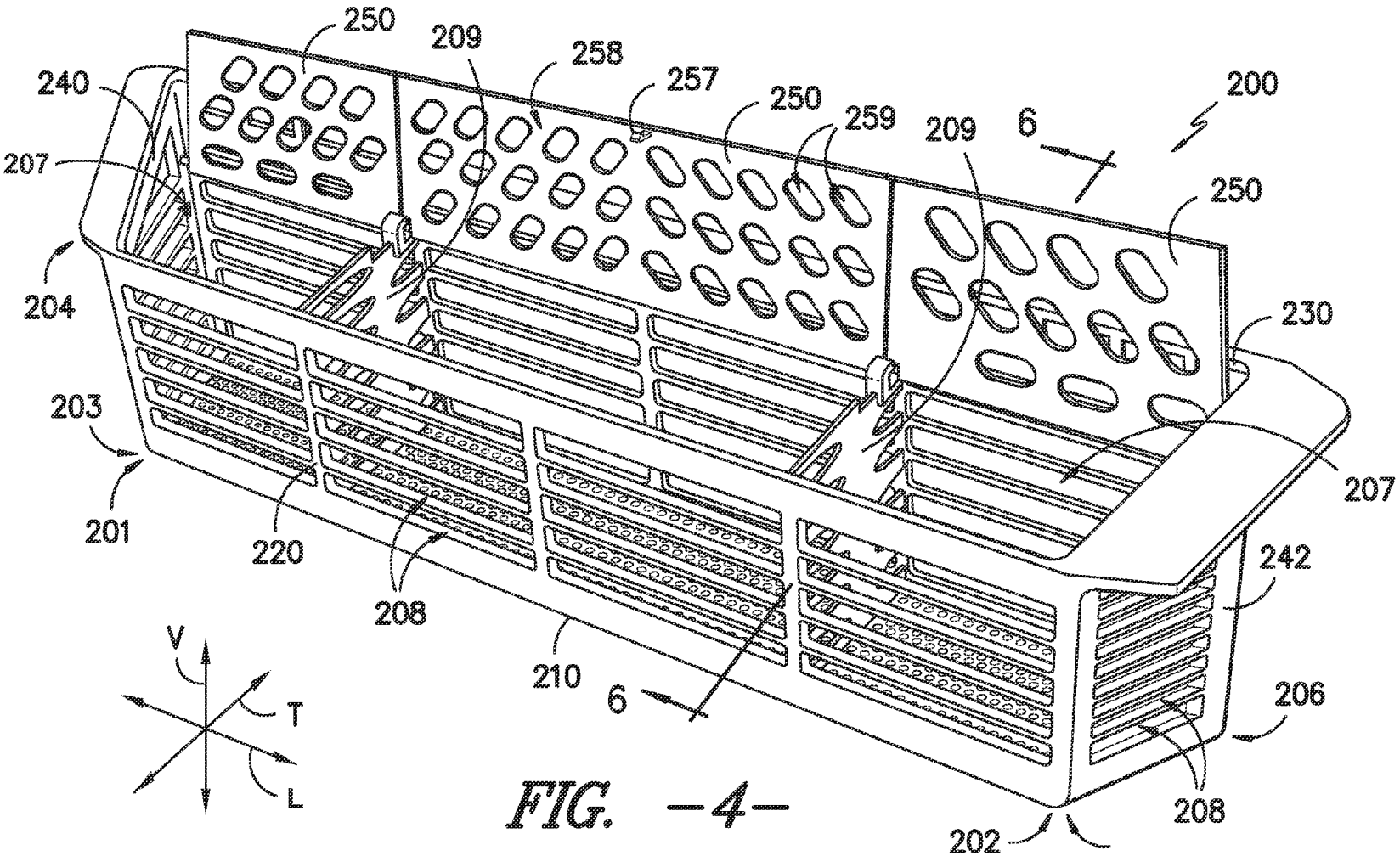
FIG. —4—

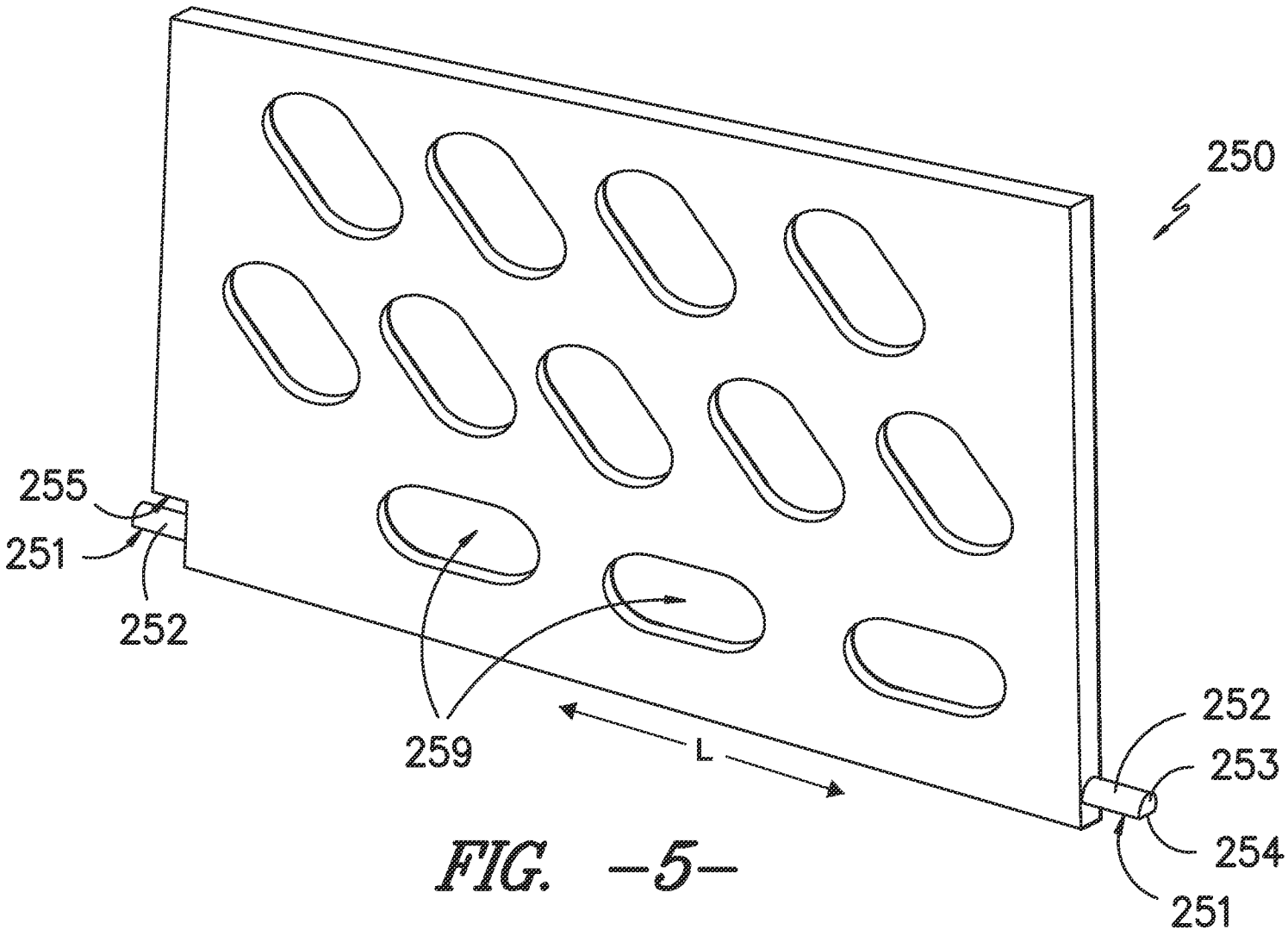
FIG. —5—

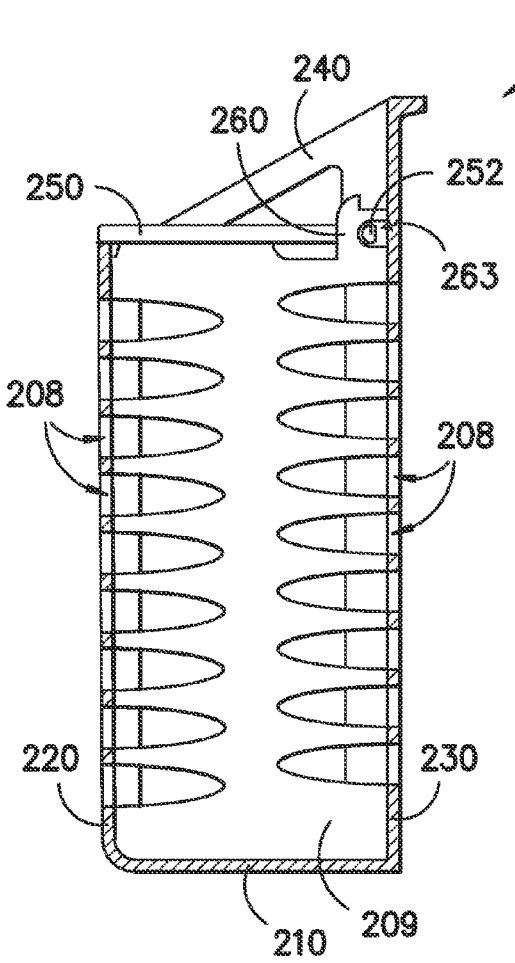
FIG. —6—
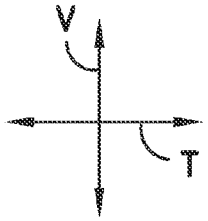
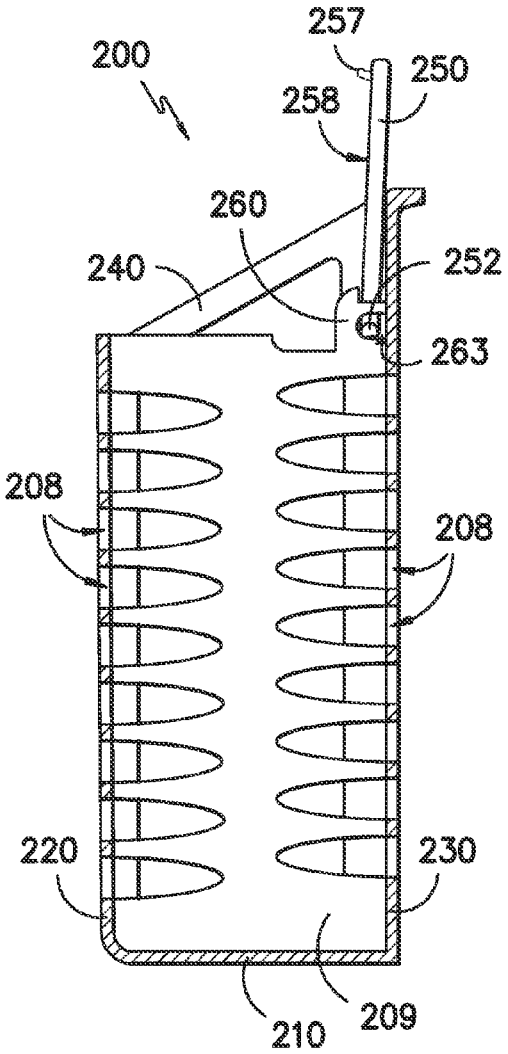
FIG. —7—

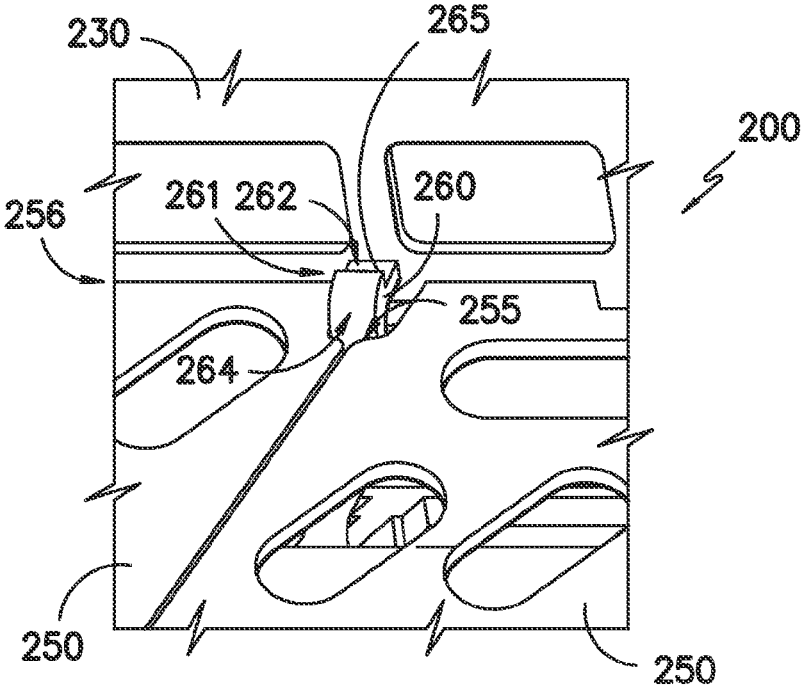
FIG. —8—
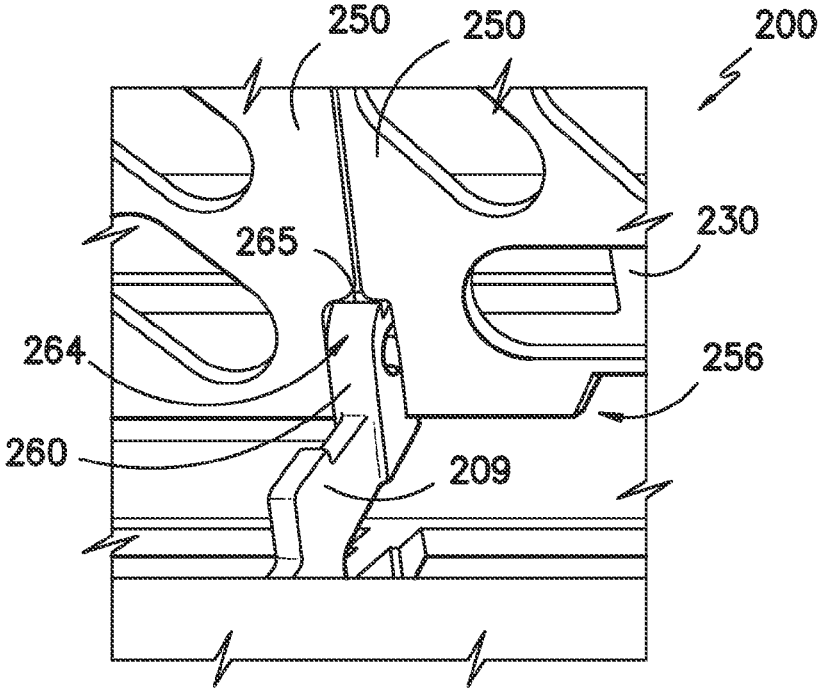
FIG. —9—

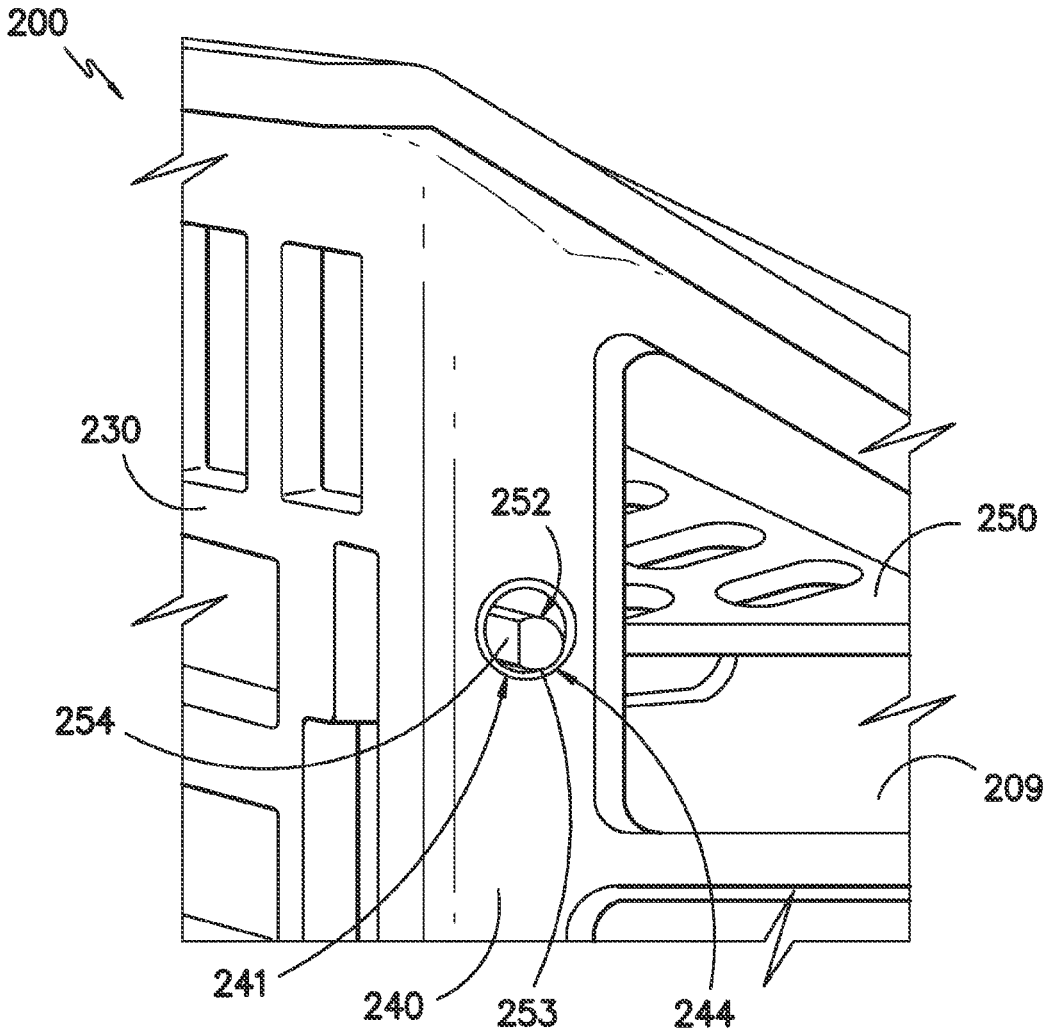
FIG. –10–

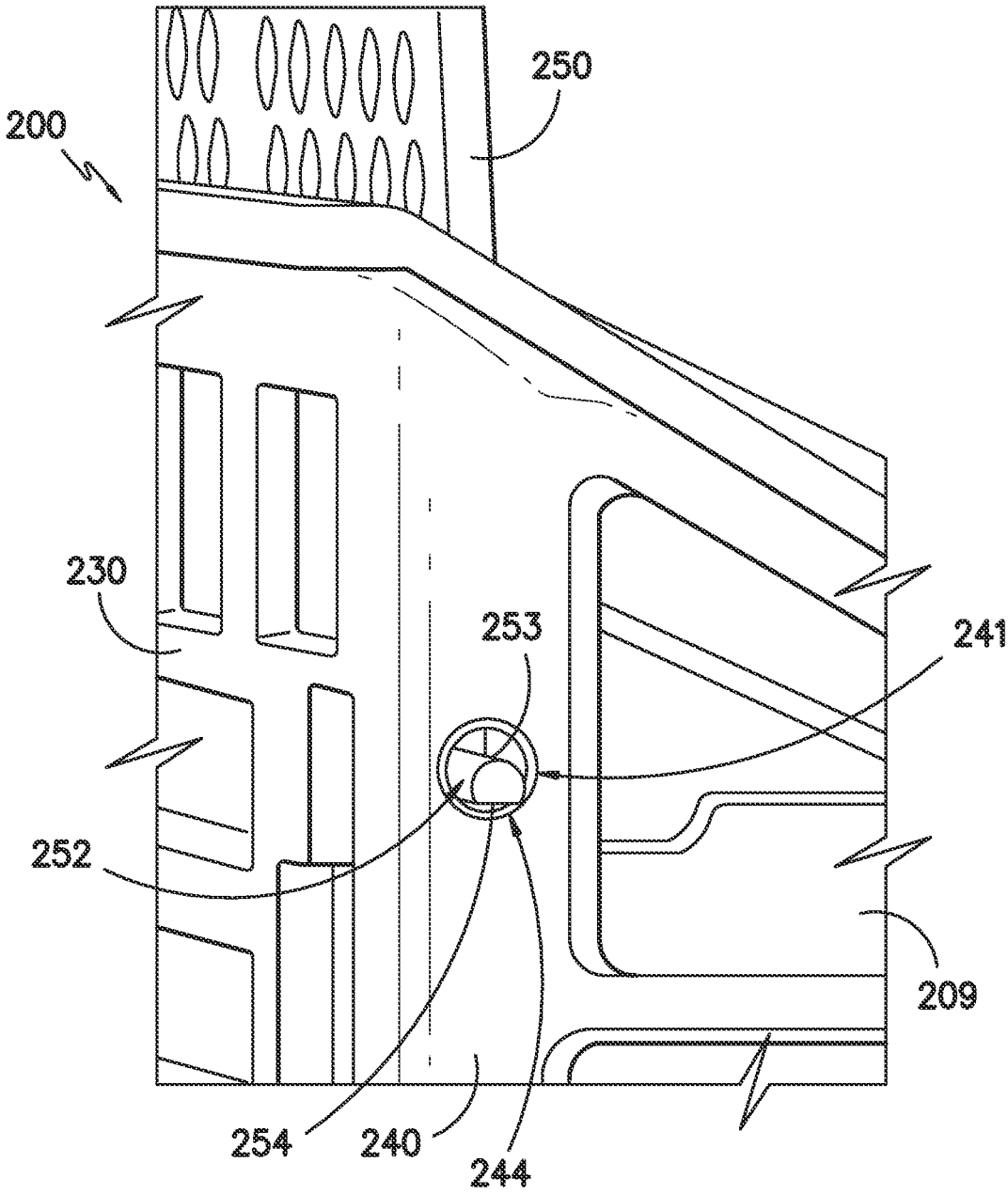
FIG. –11–

SILVERWARE BASKET FOR A DISHWASHER APPLIANCE

FIELD OF THE INVENTION

The present subject matter relates generally to silverware baskets for dishwasher appliances.

BACKGROUND OF THE INVENTION

Dishwasher appliances generally include a tub that defines a wash chamber for receipt of articles for washing. In addition, dishwasher appliances generally include a silverware basket that can be mounted at various locations within the wash chamber, e.g., on a door of the appliance, on a front of a rack assembly mounted within the wash chamber, or within the rack assembly. A user can load utensils such as forks, spoons, and knives into the silverware basket. During operation of the dishwasher appliance, wash liquid from a spray assembly can flow into and through the silverware basket to clean the utensils located within the silverware basket.

In particular, wash liquid can enter silverware basket at a significant velocity during operation of dishwasher appliances. Such wash liquid can impact a utensil within the silverware basket and lift the utensil out of the silverware basket. Outside of the silverware basket the utensil can negatively affect operation of the dishwasher appliance. For example, the utensil can jam a rotating spray arm or clog a drain.

Certain silverware baskets include features for hindering unwanted or undesirable removal of utensils from the silverware basket. For example, certain silverware baskets include covers rotatably mounted to the silverware basket. The cells covers can act as a lid for the silverware basket when the covers are in a closed position thereby hindering removal of utensils from the silverware basket. Conversely, a user can freely add or remove utensils from the silverware basket when the covers are in an open position.

Generally, covers can rotate between the open and closed positions easily. However, such easy rotation can lead to user frustration with the cells covers. For example, certain covers can rotate between the open and closed positions at unwanted times. In particular, gravity can urge the covers to rotate closed from the open position. Unwanted rotation between the open and closed positions can occur at inopportune times such as when a user is loading or unloading utensils from the silverware basket. User frustration with such unwanted rotation can cause the user to remove the covers thereby increasing the chance that a utensil will exit the silverware basket and negatively affect dishwasher operations.

Accordingly, a silverware basket with features for maintaining utensils within the silverware basket would be useful. In particular, a silverware basket with features for selectively maintaining a cover of the silverware basket in an open position would useful.

BRIEF DESCRIPTION OF THE INVENTION

The present subject matter provides a silverware basket for a dishwasher appliance. The silverware basket appliance includes features for selectively securing a cover of the silverware basket in an open position. To selectively secure the cover in an open position, the silverware basket can include a pin with a noncircular cross-section that rotatably mounts the cover to the silverware basket or a recess defined by a brace that can receive a portion of the cover in the open position or both. Additional aspects and advantages of the invention will be set forth in part in the following description, or may be apparent from the description, or may be learned through practice of the invention.

In a first exemplary embodiment, a silverware basket for a dishwasher appliance is provided. The silverware basket extends between a top and a bottom along a vertical direction. The silverware basket also extends between a first side and a second side along a lateral direction. The silverware basket further extends between a front and a back along a transverse direction. The vertical, lateral, and transverse directions are mutually perpendicular. The silverware basket includes a bottom wall and a back wall extending from the bottom wall along the vertical direction. A front wall extends from the bottom wall along the vertical direction. The front wall is spaced apart from the back wall along the transverse direction. A pair of sidewalls is spaced apart along the lateral direction. The pair of sidewalls extends between and connects the back wall and the front wall along the transverse direction. A cover is rotatably mounted to the back wall. The cover has an edge. A brace is mounted to the back wall. The brace defines a recess configured for receipt of the edge of the cover when the cover is in an open position.

In a second exemplary embodiment, a silverware basket for a dishwasher appliance is provided. The silverware basket extends between a top and a bottom along a vertical direction. The silverware basket also extends between a first side and a second side along a lateral direction. The silverware basket further extends between a front and a back along a transverse direction. The vertical, lateral, and transverse directions are mutually perpendicular. The silverware basket includes a bottom wall and a back wall extending from the bottom wall along the vertical direction. A front wall extends from the bottom wall along the vertical direction. The front wall is spaced apart from the back wall along the transverse direction. A pair of sidewalls is spaced apart along the lateral direction. The pair of sidewalls extends between and connects the back wall and the front wall along the transverse direction. A brace is mounted to the back wall. The brace defines a hole. A cover has a pin about which the cover is rotatable. The pin of the cover is received within the hole of the brace. The pin of the cover has a contact surface for engaging the brace. The contact surface of the pin has a noncircular lateral cross-section.

In a third exemplary embodiment, a dishwasher appliance is provided. The dishwasher appliance includes a tub that defines a wash chamber. A door is mounted proximate the tub for permitting selective access to the wash chamber of the tub. A rack assembly is received within the wash chamber of the tub. A silverware rack is mounted to the rack assembly. The silverware basket extends between a top and a bottom along a vertical direction. The silverware basket also extends between a first side and a second side along a lateral direction. The silverware basket further extends between a front and a back along a transverse direction. The vertical, lateral, and transverse directions are mutually perpendicular. The silverware basket includes a bottom wall and a back wall extending from the bottom wall along the vertical direction. A front wall extends from the bottom wall along the vertical direction. The front wall is spaced apart from the back wall along the transverse direction. A pair of sidewalls is spaced apart along the lateral direction. The pair of sidewalls extends between and connects the back wall and the front wall along the transverse direction. A cover has a pin about which the cover is rotatable. The pin of the cover has a contact surface. The contact surface of the pin has a noncircular lateral cross-section. The cover also has an edge. A brace is mounted to the back wall. The brace defines a hole. The pin of the cover is received within the hole of the brace such that the contact surface of the pin engages the brace. The brace also defines a recess configured for receipt of the edge of the cover when the cover is in an open position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 4 illustrates a perspective view of the silverware basket of FIG. 2 with the exemplary covers of the silverware basket shown in an open position.

FIG. 5 provides a perspective view of the cover of FIG. 4 removed from the silverware basket.

FIG. 6 illustrates a cross-sectional view of the silverware basket of FIG. 3 taken along the 5-5 line of FIG. 3.

FIG. 7 illustrates a cross-sectional view of the silverware basket of FIG. 4 taken along the 6-6 line of FIG. 4.

FIG. 8 provides a perspective view of a brace of the silverware basket of FIG. 3.

FIG. 9 provides a perspective view of the brace of the silverware basket of FIG. 4.

FIG. 10 provides a perspective view of a pin of the cover of FIG. 3.

FIG. 11 provides a perspective view of the pin of the cover of FIG. 4.

DETAILED DESCRIPTION

Figure 1:
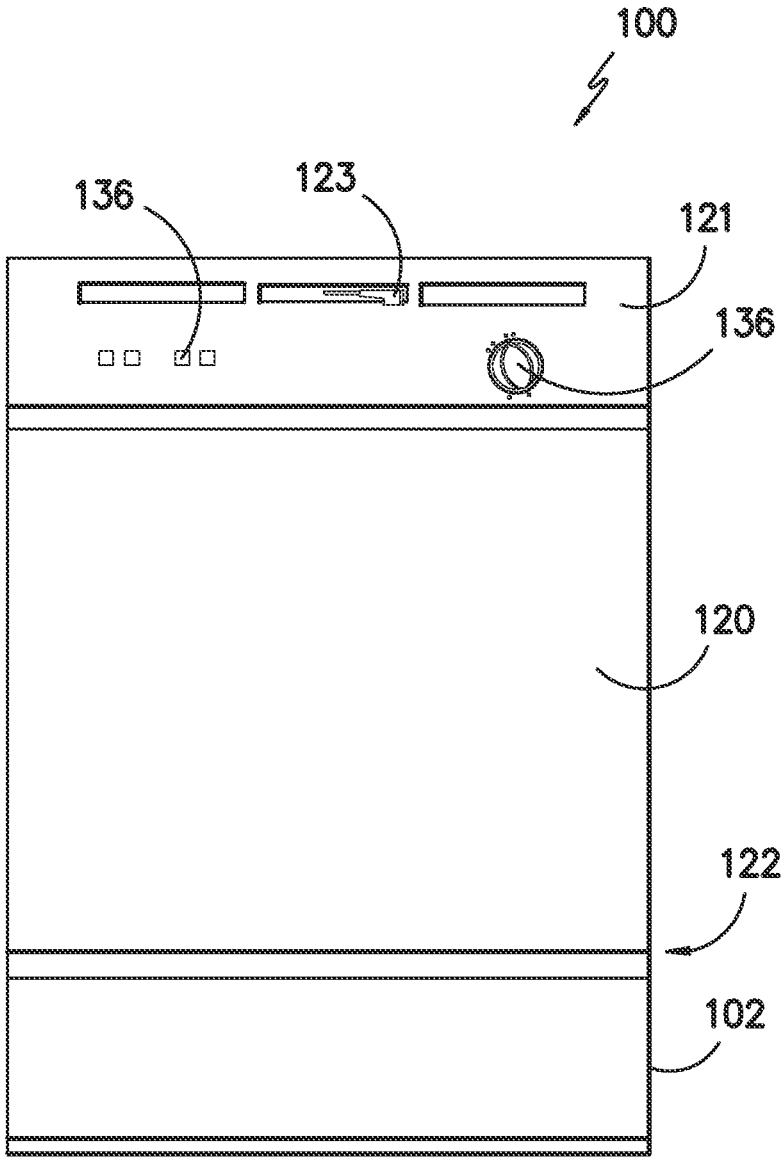
FIG. 1 provides a front view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
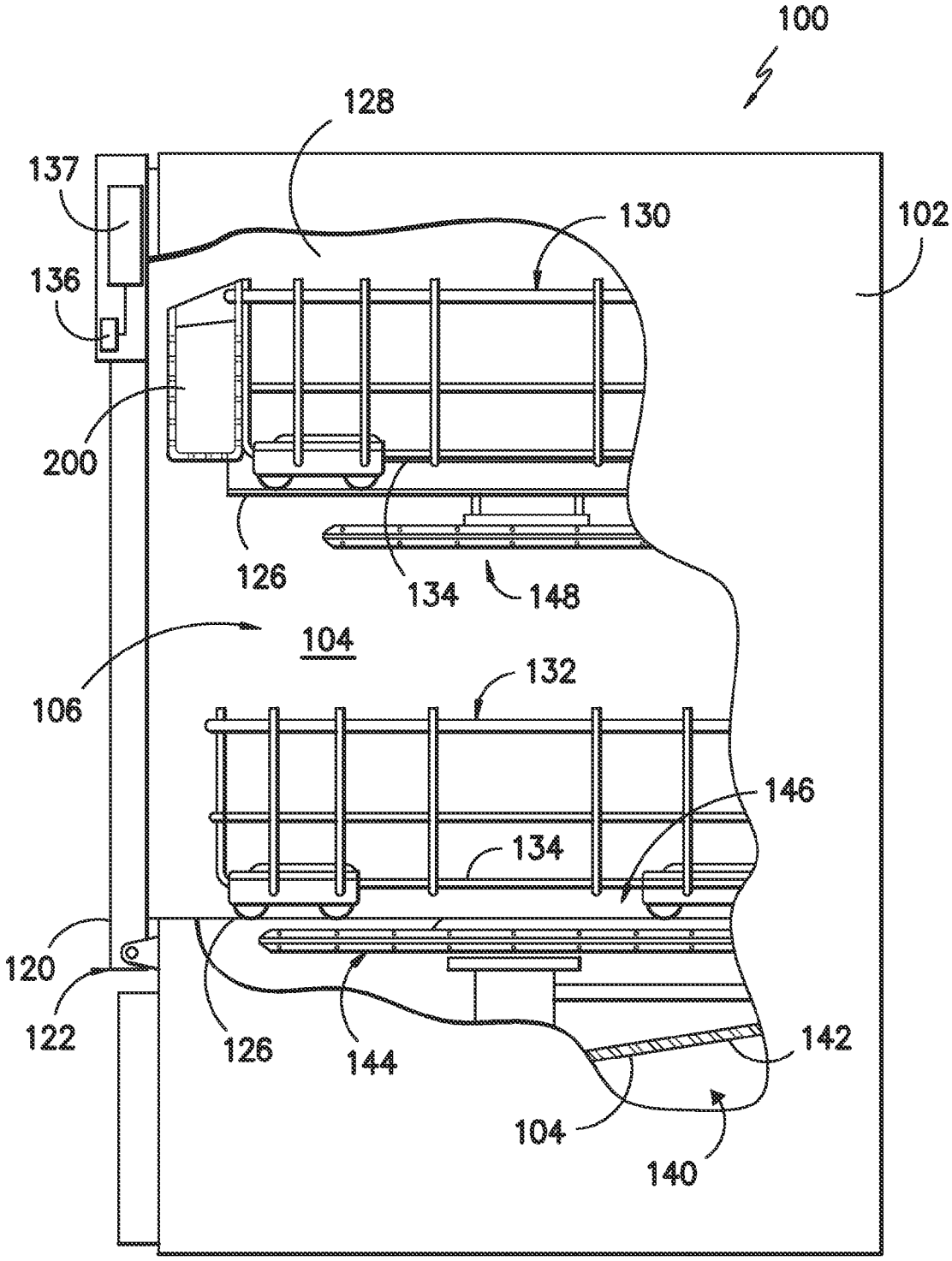
FIG. 2 illustrates a side view of the dishwasher appliance of FIG. 2 with portions of a cabinet of the dishwasher appliance removed to illustrate a wash chamber of the cabinet and, in particular, to illustrate an exemplary embodiment of a silverware basket mounted to an upper rack assembly of the dishwasher appliance.

FIGS. 1 and 2 depict an exemplary domestic dishwasher appliance 100 that may be configured in accordance with aspects of the present disclosure. As best shown in FIG. 2, dishwasher appliance 100 includes a cabinet 102 having a tub 104 therein that defines a wash chamber 106. Dishwasher appliance 100 also includes a door 120 hinged at its bottom 122 for movement between a normally closed configuration (shown in FIGS. 1 and 2), wherein the wash chamber 106 of tub 104 is sealed shut (e.g., for washing operation), and an open configuration (e.g., for loading and unloading of articles from the dishwasher appliance 100). A latch 123 (FIG. 1) is used to lock and unlock the door 120 for access to the chamber 106.

Guide rails 126 are mounted on tub side walls 128 and accommodate upper and lower roller-equipped rack assemblies 130, 132. However, dishwasher appliance 100 need not include guide rails 126. For example, upper and/or lower rack assemblies 130 and 132 may be supported within wash chamber 106 by molded features on tub 104. Each of the upper and lower racks 130, 132 is fabricated from lattice structures that include a plurality of elongated members 134. Each rack 130, 132 is adapted for movement between an extended loading position (not shown) in which the rack is substantially positioned outside the wash chamber 106, and a retracted position (shown in FIGS. 1 and 2) in which the rack is located inside wash chamber 106.

A silverware basket 200 is removably mounted to upper rack assembly 130. However, in alternative exemplary embodiments, silverware basket 200 may also be selectively attached to other portions of dishwasher appliance 100, e.g., lower rack assembly 132 or door 120. Silverware basket 200 is configured for receipt of silverware, utensils, and the like, that are too small to be accommodated by the upper and lower rack assemblies 130, 132. Silverware basket 200 may be constructed of any suitable material, e.g., metal or plastic, and is discussed in greater detail below.

Dishwasher appliance 100 further includes a lower spray assembly 144 that is (e.g., rotatably) mounted within a lower region 146 of the wash chamber 106 and above a tub sump portion 142 so as to positioned in relatively close proximity to the lower rack 132. A mid-level spray assembly 148 is located in an upper region of the wash chamber 106 and may be located in close proximity to upper rack assembly 130. Additionally, an upper spray assembly (not shown) may be located above the upper rack assembly 130.

The lower and mid-level spray assemblies 144, 148 and the upper spray assembly are fed by a fluid circulation assembly (not shown) for circulating water and wash fluid (e.g., water, detergent, and/or rinse aid) in wash chamber 106 of tub 104. Portions of the fluid circulation assembly may be located in a machinery compartment 140 located below the bottom sump portion 142 of the tub 104, as will be generally recognized in the art. Lower and mid-level spray assemblies 144 and 148 include an arrangement of discharge ports or orifices for directing washing liquid onto dishes or other articles located in the upper and lower rack assemblies 130, 132, respectively and silverware basket 200. The arrangement of the discharge ports in at least the lower spray assembly 144 may provide a rotational force by virtue of washing fluid flowing through the discharge ports. The resultant rotation of the lower spray assembly 144 provides coverage of dishes and other dishwasher contents with a washing spray.

Dishwasher appliance 100 is further equipped with a controller 137 to regulate operation of dishwasher appliance 100. The controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one exemplary embodiment, the processor executes programming instructions stored in memory. The memory may be a separate component from the processor or may be included onboard within the processor.

The controller 137 may be positioned in a variety of locations throughout dishwasher appliance 100. In the illustrated exemplary embodiment shown in FIG. 1, the controller 137 may be located within a control panel area 121 (FIG. 1) of door 120 as shown. In such an embodiment, input/output ("I/O") signals may be routed between the control system and various operational components of dishwasher appliance 100 along wiring harnesses that may be routed through the bottom 122 of door 120. Typically, the controller 137 includes a user interface 136 through which a user may select various operational features and modes and monitor progress of the dishwasher appliance 100. In one exemplary embodiment, the user interface 136 may represent a general purpose I/O ("GPIO") device or functional block. In one exemplary embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher and that the exemplary embodiment depicted in FIGS. 1 and 2 is for illustrative purposes only. For example, the present subject matter may be used in dishwasher appliances having other rack configurations.

Figure 3:
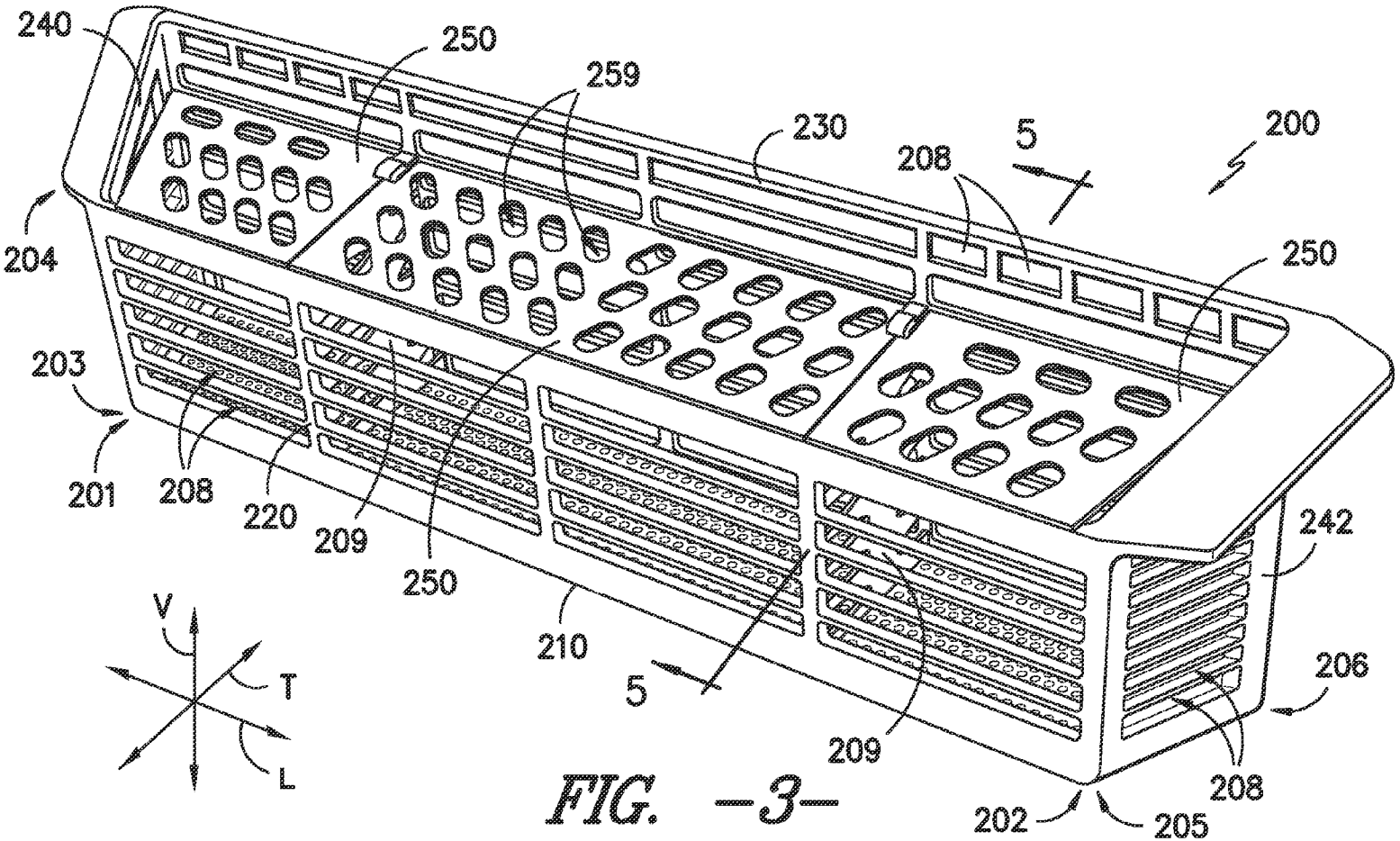
FIG. 3 provides a perspective view of the silverware basket of FIG. 2 with exemplary covers of the silverware basket in a closed position.

FIGS. 3 and 4 provide perspective views of silverware basket 200 according to an exemplary embodiment of the present subject matter. In FIG. 3, covers 250 of silverware basket 200 are shown in a closed position. In FIG. 4, covers 250 of silverware basket 200 are shown in an open position.

As may be seen in FIGS. 3 and 4, silverware basket 200 extends between a first side 201 and a second side 202 along a lateral direction L. Silverware basket 200 also extends between a top 203 and a bottom 204 along a vertical direction V. Silverware basket 200 further extends between a front 205 and a back 206 along a transverse direction T. Vertical direction V, lateral direction L, and transverse direction T are orthogonally oriented such that vertical direction V, lateral direction L, and transverse direction T form an orthogonal directional system.

Silverware basket 200 includes a bottom wall 210. A front wall 220 extends from bottom wall 210 along the vertical direction V. Similarly, a back wall 230 extends from bottom wall 210 along the vertical direction V. Back wall 230 and front wall 220 are spaced apart along the transverse direction T. A first sidewall 240 is disposed on first side 201 of silverware basket 200. A second sidewall 242 is disposed on second side 202 of silverware basket 200. First and second sidewalls 240 and 242 are spaced apart along the lateral direction L. First and second sidewalls 240 and 242 also extend between and connect back wall 230 and front wall 220. Similarly, dividers 209 extend between and connect front wall 220 and back wall 230 along the transverse direction T. As best shown in FIG. 4, bottom wall 210, front wall 220, back wall 230, first and second sidewalls 240 and 242, and dividers 209 define a plurality of cavities 207 configured for receipt of articles (e.g., forks, knives, spoons, and/or other utensils).

Bottom wall 210, front wall 220, back wall 230, and first and second sidewalls 240 and 242 also define a plurality of openings 208. Plurality of openings 208 permit wash fluid to flow into and out of cavity 207, e.g., during operation of dishwasher appliance 100. Plurality of openings 208 also permit a flow of air through cavities 207, e.g., to assist in drying articles therein. Covers 250 also define a plurality of opening 259 that performs a similar function.

Covers 250 rotate between the open and closed positions as shown in FIGS. 3 and 4. In the closed position shown in FIG. 3, covers 250 hinder access to cavities 207 such that utensils cannot be easily inserted into or removed from cavities 207. Thus, when covers 250 are in the closed position, utensils within cavities 207 of silverware basket 200 are hindered from exiting cavities 207, e.g., due to a jet of wash fluid entering cavity 207 through openings 208 and impacting the utensil during operation of dishwasher appliance 100 (FIG. 1). Conversely, in the open position shown in FIG. 4, covers 250 permit access to cavities 207 such that utensils can be inserted into or removed from cavities 207. Thus, when covers 250 are in the open position, a user can remove or add utensils to cavities 207, e.g., during loading or unloading of silverware basket 200.

FIG. 5 provides a perspective view of cover 250 removed from silverware basket 200. FIG. 6 illustrates a cross-sectional view of silverware basket 200 taken along the 5-5 line of FIG. 3. FIG. 7 illustrates a cross-sectional view of silverware basket 200 taken along the 6-6 line of FIG. 4. As discussed above, covers 250 are rotatably mounted to silverware basket 200. In particular, covers 250 are rotatably mounted to back wall 230. Back wall 230 includes braces or supports 260 mounted thereto. Supports 260 define a hole 263 that extends into or through support 260 along the lateral direction L (FIG. 3). Hole 263 receives a pin 252 of cover 250. Pin 252 extends longitudinally along the lateral direction L into hole 263 of support 260. Pin 252 can rotate or pivot within hole 263 of support 260 as cover 250 shifts between the open and closed positions. Support 260 is positioned on back wall 230 where divider 209 connects with back wall 230. In particular, support 260 may be mounted (e.g., integrally connected) to both back wall 230 and divider 209 for greater structural integrity.

Cover 250 may be adjusted to the open position during loading and unloading of silverware basket 200. As will be understood by those skilled in the art, in the open position, gravity can urge cover 250 to rotate towards the closed position at an undesired time. Pin 252 and support 260 include features for selectively securing cover 250 in the open position such that cover 250 is hindered from rotating towards the closed position as discussed in greater detail below.

FIG. 8 provides a perspective view of support 260 of silverware basket 200 with cover 250 in the closed position. FIG. 9 provides a perspective view of support 260 of silverware basket 200 with cover 250 in the open position. As best shown in FIG. 8, support 260 defines recess 262 at a top 261 of support 260. Support 260 also includes an arcuate surface 264. Cover 250 has an edge 255 positioned at a back 256 of cover 250. Recess 262 of support 260 is sized for receipt of edge 255 of cover 250 as described in greater detail below.

From the closed position shown in FIG. 8, a user can lift on cover 250 to adjust cover 250 to the open position shown in FIG. 9. In particular, as the user rotates cover 250, edge 255 of cover 250 slides along arcuate surface 264 of support 260. As cover 250 approaches the open position and edge 255 of cover 250 reaches top 261 of support 260, edge 255 (FIG. 8) of cover 250 drops into recess 262 (FIG. 8) of support 260 as shown in FIG. 9. Cover 250 is positioned substantially vertically in the open position. Thus, gravity urges edge 255 of cover 250 to drop into and remain within recess 262 of support 260 in the open position.

Support 260 can hinder rotation of cover 250 by receiving edge 255 of cover 250. For example, as discussed above, gravity can urge cover 250 to rotate closed from the open position. However, with edge 255 of cover 250 received within recess 262 of support 260, a portion of cover 250 adjacent edge 255 of cover 250 will impact a front lip 265 (FIG. 9) of support 260 during such rotation. Such impact can impede rotation of cover 250. Thus, support 260 can hamper unwanted rotation of cover 250 to the closed position. Cover 250 also includes features for hampering unwanted rotation of cover 250 to the closed position as discussed in greater detail below.

Turning back to FIG. 5, pin 252 has a contact surface 251 that engages support 260, as described above, and/or sidewalls 240 and 242, as described below, to rotatably mount cover 250 to silverware basket 200. As may be seen in FIG. 5, contact surface 251 has a noncircular lateral cross-section. As used herein, "lateral cross-section" means a cross-section in a plane that is perpendicular to the lateral direction L. Thus, as may be seen in FIG. 5, the lateral cross-section of contact surface 251 is non-circular because a cross-section of contact surface 251 in a plane that is perpendicular to the longitudinal direction L is non-circular. In particular, contact surface 251 has an arcuate portion 253 and a substantially linear or flat portion 254 that form the noncircular lateral cross-section of contact surface 251. However, contact surface 251 may have other suitable cross-section. For example, contact surface 251 may be oval, rectangular, triangular, and/or may be asymmetrical as viewed along the lateral direction L.

FIG. 10 provides a perspective view of pin 252 of cover 250 with cover 250 in the closed position. FIG. 11 provides a perspective view of pin 252 of cover 250 with cover 250 in the open position. In FIGS. 10 and 11, pin 252 is mounted within a hole 241 defined by first sidewall 240. Hole 241 of first sidewall 240 assists hole 263 of support 260 (FIG. 6) in rotatably mounting cover 250 to silverware basket 200. Hole 241 of first sidewall 240 is substantially similar to hole 263 of support 260.

Pin 252 rotates within hole 241 of first sidewall 240. As may be seen in FIG. 10, when cover 250 is in the closed position, arcuate portion 253 of pin 252 is positioned at a bottom of 244 of hole 241, and substantially flat portion 254 is positioned away from bottom of 244 of hole 241. Conversely, as may be seen in FIG. 11, when cover 250 is in the open position, substantially flat portion 254 is positioned at bottom of 244 of hole 241. As an example, from the closed position shown in FIG. 10, a user can lift on cover 250 to being rotating cover 250 to the open position. Pin 252 rotates within hole 241 of first sidewall 240 such that arcuate portion 253 of pin 252 slides along bottom 244 of hole 241 of first sidewall 240 until cover 250 reaches the open position shown in FIG. 11 and substantially flat portion 254 is positioned at bottom of 244 of hole 241.

Substantially flat portion 254 of pin 252 can hinder rotation of cover 250. For example, as will be understood by those skilled in the art, arcuate portion 253 of pin 252 facilitates rotation of cover 250 because arcuate portion 253 only has a single contact point with hole 241 of first sidewall 240 when arcuate portion 253 engages hole 241 of first sidewall 240. Conversely, substantially flat portion 254 of pin 252 hinders rotation of cover 250 because substantially flat portion 254 has at least two contact points with hole 241 of first sidewall 240 when substantially flat portion 254 engages hole 241 of first sidewall 240. Thus, substantially flat portion 254 can hamper unwanted rotation of cover 250 to the closed position. Other suitable cross-sections of contact surface 251 can similarly engage hole 241 of first sidewall 240.

Substantially flat portion 254 of pin 252 also assists in permitting edge 255 of cover 250 to drop into recess 262 of support 260 as shown in FIG. 9. For example, as will be understood by those skilled in the art, arcuate portion 253 of pin 252 is positioned further a center of rotation of pin 252 relative to substantially flat portion 254 of pin 252. Thus, when substantially flat portion 254 of pin 252 is positioned at bottom 244 of hole 241 of first sidewall 240, edge 255 of cover 250 drops into recess 262 of support 260 as shown in FIG. 9.

Turning back to FIG. 4, cover 250 includes a clasp or latch 257 mounted to a bottom surface 258 of cover 250. Latch 257 engages front wall 220 when cover 250 is in the closed position shown in FIG. 3. When latch 257 engages front wall 220, latch 257 hinders cover 250 from rotating open.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A silverware basket for a dishwasher appliance, the silverware basket extending between a top and a bottom along a vertical direction, the silverware basket extending between a first side and a second side along a lateral direction, the silverware basket also extending between a front and a back along a transverse direction, the vertical, lateral, and transverse directions being mutually perpendicular, the silverware basket comprising:

a bottom wall;

a back wall extending from said bottom wall along the vertical direction; and a front wall extending from said bottom wall along the vertical direction, said front wall spaced apart from said back wall along the transverse direction;

a pair of sidewalls spaced apart along the lateral direction, said pair of sidewalls extending between and connecting said back wall and said front wall along the transverse direction;

a cover rotatably mounted to said back wall, said cover having an edge, the edge of said cover positioned at a lateral end of said cover and spaced apart from a back portion of said cover; and a brace mounted to said back wall and extending along the transverse direction towards said front wall, said brace defining a vertically oriented recess configured for receipt of the edge of said cover when said cover is in an open position, the recess of said brace positioned between an arcuate surface of said brace and said back wall along the transverse direction.

2. The silverware basket of claim 1, further comprising a divider disposed between said pair of sidewalls along the lateral direction, said divider extending between and connecting said back wall and said front wall along the transverse direction.

3. The silverware basket of claim 2, wherein said brace is positioned on said back wall where said divider connects with said back wall.

4. The silverware basket of claim 1, wherein said cover comprises a pin about which said cover is rotatable, said pin received within a hole defined by said brace, said pin having a contact surface that engages said brace, the contact surface having a noncircular lateral cross-section.

5. The silverware basket of claim 4, wherein the contact surface of said pin comprises an arcuate portion and a substantially linear portion.

6. The silverware basket of claim 5, wherein the substantially linear portion of the contact surface is positioned at a bottom of the hole of said brace when said cover is in the open position.

7. The silverware basket of claim 1, wherein said bottom wall, said back wall, said front wall, and said cover each define a plurality openings for permitting liquids to flow through the silverware basket.

8. The silverware basket of claim 1, further comprising a clasp mounted to said cover, said clasp configured for engaging said front wall when said cover is in a closed position.

9. A silverware basket for a dishwasher appliance, the silverware basket extending between a top and a bottom along a vertical direction, the silverware basket extending between a first side and a second side along a lateral direction, the silverware basket also extending between a front and a back along a transverse direction, the vertical, lateral, and transverse directions being mutually perpendicular, the silverware basket comprising:

a bottom wall;

a back wall extending from said bottom wall along the vertical direction; and a front wall extending from said bottom wall along the vertical direction, said front wall spaced apart from said back wall along the transverse direction;

a pair of sidewalls spaced apart along the lateral direction, said pair of sidewalls extending between and connecting said back wall and said front wall along the transverse direction;

a brace mounted to said back wall and extending along the transverse direction towards said front wall, said brace defining a hole, the hole of said brace positioned between an arcuate surface of said brace and said back wall along the transverse direction, said brace also defining a vertically oriented recess, the recess of said brace positioned between the arcuate surface of said brace and said back wall along the transverse direction;

a cover having a pin about which said cover is rotatable, the pin of said cover received within the hole of said brace, the pin of said cover having a contact surface for engaging said brace, the contact surface of the pin having a noncircular lateral cross-section, said cover also having an edge, the edge of said cover positioned at a lateral end of said cover and spaced apart from a back portion of said cover, the vertically oriented recess of said brace configured for receipt of the edge of said cover when said cover is in an open position.

10. The silverware basket of claim 9, wherein the contact surface of the pin comprises an arcuate portion and a substantially linear portion.

11. The silverware basket of claim 10, wherein the substantially linear portion of the contact surface is positioned at a bottom of the hole of said brace when said cover is in an open position.

12. The silverware basket of claim 9, wherein said brace defines a recess configured for receipt of an edge of said cover when said cover is in an open position.

13. The silverware basket of claim 9, further comprising a divider disposed between said pair of sidewalls along the lateral direction, said divider extending between and connecting said back wall and said front wall along the transverse direction.

14. The silverware basket of claim 13, wherein said brace is positioned on said back wall where said divider connects with said hack wall.

15. The silverware basket of claim 9, wherein said bottom wall, said back wall, said front wall, and said cover each define a plurality openings for permitting liquids to flow through the silverware basket.

16. The silverware basket of claim 9, further comprising a clasp mounted to said cover, said clasp configured for engaging said front wall when said cover is in a closed position.

17. A dishwasher appliance comprising:

a tub defining a wash chamber;

a door mounted proximate said tub for permitting selective access to the wash chamber of said tub;

a rack assembly received within the wash chamber of said tub;

a silverware basket mounted to said rack assembly, the silverware basket extending between a top and a bottom along a vertical direction, the silverware basket extending between a first side and a second side along a lateral direction, the silverware basket also extending between a front and a back along a transverse direction, the vertical, lateral, and transverse directions being mutually perpendicular, the silverware basket comprising:

a bottom wall;

a back wall extending from said bottom wall along the vertical direction; and a front wall extending from said bottom wall along the vertical direction, said front wall spaced apart from said back wall along the transverse direction;

a pair of sidewalk spaced apart along the lateral direction, said pair of sidewalk extending between and connecting said back wall and said front wall along the transverse direction;

a cover having a pin about which said cover is rotatable, the pin of said cover having a contact surface, the contact surface of the pin having a noncircular lateral cross-section, said cover also having an edge, the edge of said cover positioned at a lateral end of said cover and spaced apart from a back portion of said cover; and a brace mounted to said back wall and extending along the transverse direction towards said front wall, said brace defining a hole, the pin of said cover received within the hole of said brace such that the contact surface of the pin engages said brace, said brace also defining a vertically oriented recess configured for receipt of the edge of said cover when said cover is in an open position, the recess of said brace positioned between an arcuate surface of said brace and said back wall along the transverse direction.

18. The dishwasher of claim 17, wherein the contact surface of the pin comprises an arcuate portion and a substantially linear portion.

19. The dishwasher of claim 18, wherein the substantially linear portion of the contact surface is positioned at a bottom of the hole of said brace when said cover is in the open position.

* * * * *

UNITED STATES PATENT AND TRADEMARK OFFICE

CERTIFICATE OF CORRECTION

PATENT NO. : 8,733,859 B2
APPLICATION NO. : 13/493272
DATED : May 27, 2014
INVENTOR(S) : Darrell W. Shewmaker et al.

It is certified that error appears in the above-identified patent and that said Letters Patent is hereby corrected as shown below:

In the Claims:

Column 10, line 8, claim 14 delete "hack" and replace with "back"

should read "with said back wall."

Column 10, line 36, claim 17 delete "sidewalk" and replace with "sidewalls"

should read "a pair of sidewalls spaced apart along the lateral direction,"

Column 10, line 37, claim 17 delete "sidewalk" and replace with "sidewalls"

should read "said pair of sidewalls extending between and connecting"

Signed and Sealed this
Fifth Day of August, 2014

Michelle K. Lee

Michelle K. Lee
*Deputy Director of the United States Patent and Trademark Office*